US007418388B2

(12) United States Patent
Kondo

(10) Patent No.: US 7,418,388 B2
(45) Date of Patent: Aug. 26, 2008

(54) VOICE SYNTHESIZING METHOD USING INDEPENDENT SAMPLING FREQUENCIES AND APPARATUS THEREFOR

(75) Inventor: Reishi Kondo, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/534,350

(22) Filed: Sep. 22, 2006

(65) Prior Publication Data

US 2007/0016424 A1 Jan. 18, 2007

Related U.S. Application Data

(63) Continuation of application No. 10/124,250, filed on Apr. 18, 2002, now Pat. No. 7,249,020.

(30) Foreign Application Priority Data

Apr. 18, 2001 (JP) ..... 2001-119231

(51) Int. Cl.
*G10L 13/00* (2006.01)

(52) U.S. Cl. ..... 704/258; 704/265

(58) Field of Classification Search ..... 704/258, 704/265, 267–269

See application file for complete search history.

(56) References Cited

U.S. PATENT DOCUMENTS

| | | | | |
|---|---|---|---|---|
| 4,214,125 | A | 7/1980 | Mozer et al. | |
| 4,330,689 | A | 5/1982 | Kang et al. | |
| 4,392,018 | A | 7/1983 | Fette | |
| 4,700,391 | A | 10/1987 | Leslie et al. | |
| 5,611,002 | A | 3/1997 | Vogten et al. | |
| 5,704,007 | A | 12/1997 | Cecys | |
| 5,890,115 | A | 3/1999 | Cole | |
| 5,903,866 | A * | 5/1999 | Shoham | 704/265 |
| 6,138,092 | A | 10/2000 | Zinser et al. | |
| 6,539,355 | B1 * | 3/2003 | Omori et al. | 704/268 |
| 6,665,641 | B1 * | 12/2003 | Coorman et al. | 704/260 |
| 6,691,083 | B1 | 2/2004 | Breen | |
| 6,735,567 | B2 * | 5/2004 | Gao et al. | 704/258 |
| 6,754,630 | B2 * | 6/2004 | Das et al. | 704/268 |

FOREIGN PATENT DOCUMENTS

| | | | |
|---|---|---|---|
| JP | 58-219599 | A | 12/1983 |
| JP | 60-112299 | A | 6/1985 |
| JP | 64-2960 | B2 | 1/1989 |
| JP | 5-143097 | A | 6/1993 |
| JP | 8-152900 | A | 6/1996 |
| JP | 9-319390 | A | 12/1997 |
| JP | 11-95797 | A | 4/1999 |
| JP | 2000-206996 | A | 7/2000 |

* cited by examiner

*Primary Examiner*—Michael N Opsasnick
(74) *Attorney, Agent, or Firm*—Sughrue Mion, PLLC

(57) ABSTRACT

A method and a system of producing a synthesized voice is provided. A voice sound waveform is provided at a voice sampling frequency based on pronunciation informations. A voice-less sound waveform is produced at a voice-less sampling frequency based on the pronunciation informations. The voice sampling frequency is converted into an output sampling frequency to produce a frequency-converted voice sound waveform with the output sampling frequency, wherein each of the voice sampling frequency and the voice-less sampling frequency is independent from the output sampling frequency. The voice-less sampling frequency is converted into the output sampling frequency to produce a frequency-converted voice-less sound waveform with the output sampling frequency.

17 Claims, 6 Drawing Sheets

VOICE SYNTHESIZING METHOD USING INDEPENDENT SAMPLING FREQUENCIES AND APPARATUS THEREFOR

This is a continuation of application Ser. No. 10/124,250 filed Apr. 18, 2002, now U.S. Pat. No. 7,249,020. The entire disclosures of the prior application, application Ser. No. 10/124,250 is hereby incorporated by reference.

BACKGROUND OF THE INVENTION

1. Field of the Invention

The present invention relates to a voice synthesizing method, a voice synthesizing apparatus, and a semiconductor device including a voice synthesizing apparatus as well as a computer readable program to be executed for implementing a voice synthesis.

2. Description of the Related Art

In the prior arts, it has been known that the voice synthesizer produces a voice sound and a voice-less sound in different methods respectively, along the voice generation models. For example, a vocoder inputs a pulse in accordance with a pitch frequency for producing the voice sound, while using a white noise for producing the voice-less sound. This generation method may be implemented by using a digital signal processing. In this case, a common output device may be used for producing both the voice sound and the voice-less sound, wherein respective sampling frequencies for producing the voice and voice-less sounds are the same as an output sampling frequency of the common output device.

By observing a waveform of a voice sound spoken by a human, it is confirmed that a power of the voice sound is concentrated in a lower frequency band than that of a power of the voice-less sound. The optimum sampling frequency for producing the voice-less sound is too high to produce the voice sound. This leads to disadvantageous in that a waveform-editing voice synthesizing method needs a larger storing capacity for storing waveform fragments. Storing the voice waveform fragments often needs a larger capacity than storing the voice-less waveform fragments. Increase in the storage capacity is the trade-off for the size down of the voice synthesizer.

The use of the commonly uniform sampling frequency for both the voice sound and the voice-less sound has the above-described disadvantage in the trade-off between the optimization to the sampling frequency for producing the voice-less sound and the reduction to the storage capacity.

Japanese laid-open patent publication No. 60-113299 discloses processes for separately setting respective sampling frequencies of the voice sound and the voice-less sound, wherein a clock frequency to be used for reading out a waveform of a voice-less consonant is made varying in accordance with tone data. This second conventional technique is, however, disadvantageous in that the tone of the voice-less consonant varies depending on the tone data.

Japanese laid-open patent publication No. 58-219599 discloses that the voice fragments are held at the low sampling frequency for data interpolation in the voice synthesizing process in order to make the sampling frequency higher apparently, thereby obtaining a good tone synthesized voice. This third conventional technique is, however, disadvantageous in that holding the voice fragments at the low sampling frequency makes cut the voice component at the high frequency band.

In the above circumstances, the developments of novel method and apparatus for performing voice-synthesis with good tones without increasing the required storage capacity free from the above problems is desirable.

SUMMARY OF THE INVENTION

Accordingly, it is an object of the present invention to provide a novel method for performing voice-synthesis with good tones free from the above problems.

It is a further object of the present invention to provide a novel method for performing voice-synthesis with good tones without increasing the required storage capacity.

It is a still further object of the present invention to provide a novel apparatus for performing voice-synthesis with good tones free from the above problems.

It is yet a further object of the present invention to provide a novel apparatus for performing voice-synthesis with good tones without increasing the required storage capacity.

It is further more object of the present invention to provide a novel semiconductor device incorporating a functional unit for performing voice-synthesis with good tones free from the above problems.

It is moreover object of the present invention to provide a novel semiconductor device incorporating a functional unit for performing voice-synthesis with good tones without increasing the required storage capacity.

It is an additional object of the present invention to provide a novel computer-readable program to be executed for performing voice-synthesis with good tones free from the above problems.

It is a further additional object of the present invention to provide a novel computer-readable program to be executed for performing voice-synthesis with good tones without increasing the required storage capacity.

The present invention provides a method of producing a synthesized voice. A voice sound waveform is provided at a voice sampling frequency based on pronunciation informations. A voice-less sound waveform is produced at a voice-less sampling frequency based on the pronunciation informations. The voice sampling frequency is converted into an output sampling frequency to produce a frequency-converted voice sound waveform with the output sampling frequency, wherein each of the voice sampling frequency and the voice-less sampling frequency is independent from the output sampling frequency. The voice-less sampling frequency is converted into the output sampling frequency to produce a frequency-converted voice-less sound waveform with the output sampling frequency.

The above and other objects, features and advantages of the present invention will be apparent from the following descriptions.

BRIEF DESCRIPTION OF THE DRAWINGS

Preferred embodiments according to the present invention will be described in detail with reference to the accompanying drawings.

DETAILED DESCRIPTION OF THE PREFERRED EMBODIMENTS

Figure 1:
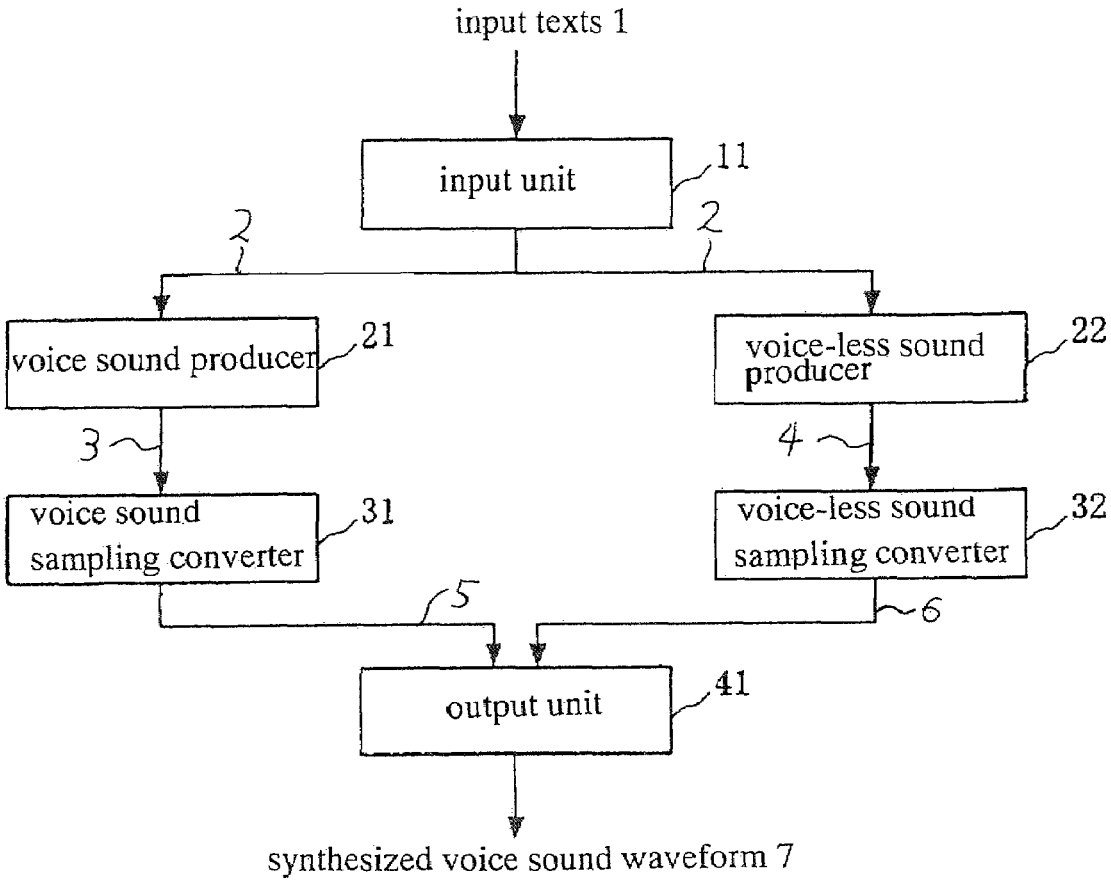
FIG. 1 is a block diagram illustrative of a configuration of a voice synthesizer in a first embodiment in accordance with the present invention.

A first aspect of the present invention is a method of producing a synthesized voice. The method includes: producing a voice sound waveform at a voice sampling frequency based on pronunciation informations; producing a voice-less sound waveform at a voice-less sampling frequency based on the pronunciation informations; converting the voice sampling frequency into an output sampling frequency to produce a frequency-converted voice sound waveform with the output sampling frequency, wherein each of the voice sampling frequency and the voice-less sampling frequency is independent from the output sampling frequency; and converting the voice-less sampling frequency into the output sampling frequency to produce a frequency-converted voice-less sound waveform with the output sampling frequency.

It is possible to further include: synthesizing the frequency-converted voice sound waveform and the frequency-converted voice-less sound waveform to produce a synthesized voice with the output sampling frequency.

It is possible to further include: producing the pronunciation informations based on an externally inputted information.

It is possible to further include: managing, over the output sampling frequency, a first voice production timing of producing the voice sound waveform and a first voice-less production timing of producing the voice-less sound waveform for each sample; converting the first voice production timing into a second voice production timing over the voice sampling frequency to produce the voice sound waveform at the second voice production timing for every samples; and converting the first voice-less production timing into a second voice-less production timing over the voice-less sampling frequency to produce the voice-less sound waveform at the second voice-less production timing for every samples.

It is possible to further include: providing a time quantization width defined between head and bottom times which have time-correspondences between a sampling frequency unconverted sample point and a sampling frequency converted sample point; and defining, for each sample, a pair of the pronunciation information and a time quantization delay at the head time of the time quantization width, and the time quantization delay corresponding to a waiting time from the head time until defining each of sampling frequency converted samples which are to be produced in the time quantization width; whereby the voice sound waveform for the each sample is produced with the time quantization delay from the head time at the voice sampling frequency based on the pronunciation information corresponding to the each of sampling frequency converted samples, and whereby the voice-less sound waveform for the each sample is produced with the time quantization delay from the head time at the voice-less sampling frequency based on the pronunciation information corresponding to the each of sampling frequency converted samples.

It is possible to further include: adding the time quantization delay with a delay time defined until a first time of one of the sampling frequency unconverted samples from a second time of corresponding one of the sampling frequency converted samples, whereby the voice sound waveform and the voice-less sound waveform are produced with a sum of the time quantization delay and the delay time.

A second aspect of the present invention is a system of producing a synthesized voice. The system includes: a function block for producing a voice sound waveform at a voice sampling frequency based on pronunciation informations; a function block for producing a voice-less sound waveform at a voice-less sampling frequency based on the pronunciation informations; a function block for converting the voice sampling frequency into an output sampling frequency to produce a frequency-converted voice sound waveform with the output sampling frequency, wherein each of the voice sampling frequency and the voice-less sampling frequency is independent from the output sampling frequency; and a function block for converting the voice-less sampling frequency into the output sampling frequency to produce a frequency-converted voice-less sound waveform with the output sampling frequency.

It is possible to further include: a function block for synthesizing the frequency-converted voice sound waveform and the frequency converted voice-less sound waveform to produce a synthesized voice with the output sampling frequency.

It is possible to further include: a function block for producing the pronunciation informations based on an externally inputted information.

It is possible to further include: a function block for managing, over the output sampling frequency, a first voice production timing of producing the voice sound waveform and a first voice-less production timing of producing the voice-less sound waveform for each sample; a function block for converting the first voice production timing into a second voice production timing over the voice sampling frequency to produce the voice sound waveform at the second voice production timing for every samples; and a function block for converting the first voice-less production timing into a second voice-less production timing over the voice-less sampling frequency to produce the voice-less sound waveform at the second voice-less production timing for every samples.

It is possible to further include: a function block for providing a time quantization width defined between head and bottom times which have time-correspondences between a sampling frequency unconverted sample point and a sampling frequency converted sample point; and a function block for defining, for each sample, a pair of the pronunciation information and a time quantization delay at the head time of the time quantization width, and the time quantization delay corresponding to a waiting time from the head time until defining each of sampling frequency converted samples which are to be produced in the time quantization width; whereby the voice sound waveform for the each sample is produced with the time quantization delay from the head time at the voice sampling frequency based on the pronunciation information corresponding to the each of sampling frequency converted samples, and whereby the voice-less sound waveform for the each sample is produced with the time quantization delay from the head time at the voice-less sampling frequency based on the pronunciation information corresponding to the each of sampling frequency converted samples.

It is possible to further include: a function block for adding the time quantization delay with a delay time defined until a first time of one of the sampling frequency unconverted samples from a second time of corresponding one of the sampling frequency converted samples, whereby the voice sound waveform and the voice-less sound waveform are produced with a sum of the time quantization delay and the delay time.

A third aspect of the present invention is a voice synthesizer including: a voice sound producing unit for producing a voice sound waveform at a voice sampling frequency based on pronunciation informations; a voice-less sound producing unit for producing a voice-less sound waveform at a voice-less sampling frequency based on the pronunciation informations; a voice sound sampling conversion unit for converting the voice sampling frequency into an output sampling frequency to produce a frequency-converted voice sound waveform with the output sampling frequency, wherein each of the voice sampling frequency and the voice-less sampling frequency is independent from the output sampling frequency; and a voice-less sound sampling conversion unit for converting the voice-less sampling frequency into the output sampling frequency to produce a frequency-converted voice-less sound waveform with the output sampling frequency.

It is possible to further include: an output unit for synthesizing the frequency-converted voice sound waveform and the frequency-converted voice-less sound waveform to produce a synthesized voice with the output sampling frequency.

It is possible to further include: an input unit for producing the pronunciation informations based on an externally inputted information.

It is possible to further include: a timing control unit for managing, over the output sampling frequency, a first voice production timing of producing the voice sound waveform and a first voice-less production timing of producing the voice-less sound waveform for each sample; and the timing control unit further converting the first voice production timing into a second voice production timing over the voice sampling frequency to produce the voice sound waveform at the second voice production timing for every samples; as well as converting the first voice-less production timing into a second voice-less production timing over the voice-less sampling frequency to produce the voice-less sound waveform at the second voice-less production timing for every samples.

It is possible to further include a timing control unit for providing a time quantization width defined between head and bottom times which have time-correspondences between a sampling frequency unconverted sample point and a sampling frequency converted sample point; and the timing control unit further defining, for each sample, a pair of the pronunciation information and a time quantization delay at the head time of the time quantization width, and the time quantization delay corresponding to a waiting time from the head time until defining each of sampling frequency converted samples which are to be produced in the time quantization width; whereby the voice sound producing unit produces the voice sound waveform for the each sample with the time quantization delay from the head time at the voice sampling frequency based on the pronunciation information corresponding to the each of sampling frequency converted samples, and whereby the voice-less sound producing unit produces the voice-less sound waveform for the each sample with the time quantization delay from the head time at the voice-less sampling frequency based on the pronunciation information corresponding to the each of sampling frequency converted samples.

It is further possible that the timing controller further adds the time quantization delay with a delay time defined until a first time of one of the sampling frequency unconverted samples from a second time of corresponding one of the sampling frequency converted samples, whereby the voice sound producing unit and the voice-less sound producing unit respectively produce the voice sound waveform and the voice-less sound waveform with a sum of the time quantization delay and the delay time.

A fourth aspect of the present invention is a semiconductor device integrating the above-described voice synthesizer.

A fifth aspect of the present invention is a computer-readable program to be executed by a computer to implement a method of producing a synthesized voice. The program includes: producing a voice sound waveform at a voice sampling frequency based on pronunciation informations; producing a voice-less sound waveform at a voice-less sampling frequency based on the pronunciation informations; converting the voice sampling frequency into an output sampling frequency to produce a frequency-converted voice sound waveform with the output sampling frequency, wherein each of the voice sampling frequency and the voice-less sampling frequency is independent from the output sampling frequency and converting the voice-less sampling frequency into the output sampling frequency to produce a frequency-converted voice-less sound waveform with the output sampling frequency.

It is possible to further include: synthesizing the frequency-converted voice sound waveform and the frequency-converted voice-less sound waveform to produce a synthesized voice with the output sampling frequency.

It is possible to further include: producing the pronunciation informations based on an externally inputted information.

It is possible to further include: managing, over the output sampling frequency, a first voice production timing of producing the voice sound waveform and a first voice-less production timing of producing the voice-less sound waveform for each sample; converting the first voice production timing into a second voice production timing over the voice sampling frequency to produce the voice sound waveform at the second voice production timing for every samples; and converting the first voice-less production timing into a second voice-less production timing over the voice-less sampling frequency to produce the voice-less sound waveform at the second voice-less production timing for every samples.

It is possible to further include: providing a time quantization width defined between head and bottom times which have time-correspondences between a sampling frequency unconverted sample point and a sampling frequency converted sample point; and defining, for each sample, a pair of the pronunciation information and a time quantization delay at the head time of the time quantization width, and the time quantization delay corresponding to a waiting time from the head time until defining each of sampling frequency converted samples which are to be produced in the time quantization width; whereby the voice sound waveform for the each sample is produced with the time quantization delay from the head time at the voice sampling frequency based on the pronunciation information corresponding to the each of sampling frequency converted samples, and whereby the voice-less sound waveform for the each sample is produced with the time quantization delay from the head time at the voice-less sampling frequency based on the pronunciation information corresponding to the each of sampling frequency converted samples.

It is possible to further include: adding the time quantization delay with a delay time defined until a first time of one of the sampling frequency unconverted samples from a second time of corresponding one of the sampling frequency converted samples, whereby the voice sound waveform and the voice-less sound waveform are produced with a sum of the time quantization delay and the delay time.

First Embodiment

A first embodiment according to the present invention will be described in detail with reference to the drawings. FIG. 1 is a block diagram illustrative of a configuration of a voice synthesizer in a first embodiment in accordance with the present invention. The voice synthesizer includes an input unit 11, a voice sound producing unit 21, a voice-less sound producing unit 22, a voice sound sampling conversion unit 31, a voice-less sound sampling conversion unit 32, and an output unit 41.

The input unit 11 receives an entry of input texts 1 which represent characters to be spoken, and produces pronunciation informations 2 necessary for producing the voice, such as a series of rhymes. The pronunciation informations 2 are transmitted to both the voice sound producing unit 21 and the voice-less sound producing unit 22.

The voice sound producing unit 21 receives the pronunciation informations 2 from the input unit 11, and produces a voice sound waveform 3 with a voice sampling frequency (Fsv). The pronunciation informations 2 include a voice component, a voice-less component and a sound-less component. This voice component has the above voice sound waveform 3. The voice component, the voice-less component and the sound-less component appear alternatively in the real vocal sound. Only the voice component is produced. If the voice component and the voice-less component overlap together in time, then only the overlapping portion of the voice component is produced.

The voice sound sampling conversion unit 31 receives the voice sampling frequency (Fsv) from the voice sound producing unit 21, and converts the received voice sampling frequency (Fsv) into an output sampling frequency (Fso), so that the voice sound sampling conversion unit 31 produces a frequency-converted voice sound waveform 5 with the output sampling frequency (Fso). The frequency conversion may be made by using a sampling conversion with a poly-phase filter. If the voice sampling frequency (Fsv) is equal to the output sampling frequency (Fso), then the above conversion is not necessary, for which reason the voice sound sampling conversion unit 31 simply outputs the frequency-unconverted voice sound waveform 5 without the above conversion process.

The voice-less sound producing unit 22 receives the pronunciation informations 2 from the input unit 11, and produces a voice-less sound waveform 4 with a voice-less sampling frequency (Fsu). As described above, the pronunciation informations 2 may include the voice component, the voice-less component and the sound-less component. This voice-less component has the above voice-less sound waveform 4. Only the voice-less component is produced. If the voice component and the voice-less component overlap together in time, then only the overlapping portion of the voice-less component is produced.

The voice-less sound sampling conversion unit 32 receives the voice-less sampling frequency (Fsu) from the voice-less sound producing unit 22, and converts the received voice-less sampling frequency (Fsu) into the above-described output sampling frequency (Fso), so that the voice-less sound sampling conversion unit 32 produces a frequency-converted voice-less sound waveform 6 with the output sampling frequency (Fso). If the voice-less sampling frequency (Fsu) is equal to the output sampling frequency (Fso), then the above conversion is not necessary, for which reason the voice-less sound sampling conversion unit 32 simply outputs the frequency-unconverted voice-less sound waveform 6 without the above conversion process.

The output unit 41 receives both the frequency-converted voice sound waveform 5 and the frequency-unconverted voice-less sound waveform 6 from the voice sound sampling conversion unit 31 and the voice-less sound sampling conversion unit 32 respectively, wherein the frequency-converted voice sound waveform 5 and the frequency-unconverted voice-less sound waveform 6 have the same sampling frequency, for example, the output sampling frequency (Fso). The output unit 41 synthesizes the frequency-converted voice sound waveform 5 and the frequency-unconverted voice-less sound waveform 6 to produce a single synthesized voice sound waveform 7.

The voice sound and the voice-less sound are separately produced by the separate two units, for which reason it is necessary that the frequency-converted voice sound waveform 5 and the frequency-unconverted voice-less sound waveform 6 are synchronized with each other or have the same timing as each other, in order to produce the single synthesized voice sound waveform 7. This synchronization may be implemented by the following example of the methods. The pronunciation informations 2 may include time informations at respective boundaries of the sound fragments, so that separate operations of the voice sound producing unit 21 and the voice-less sound producing unit 22 are synchronized with each other depending on the time informations, so as to produce the voice sound waveform 3 and the voice-less sound waveform 4 at the same or synchronized timing.

The above described voice synthesizer in accordance with the first embodiment provides the following advantages. The voice sound and the voice-less sound are separately produced by the separate two units. Namely, the voice sound producing unit 21 generates the voice sound waveform 3 with the voice sampling frequency (Fsv) as a first optimum sampling frequency, and separately the voice-less sound producing unit 22 generates the voice-less sound waveform 4 with the voice-less sampling frequency (Fsu) as a second optimum sampling frequency. This allows separate optimizations to the voice sampling frequency (Fsv) and the voice-less sampling frequency (Fsu) respectively at different or equal frequency values.

As described above, it is likely that a power of the voice sound is concentrated in a lower frequency band than that of a power of the voice-less sound. The separate optimizations to the voice sampling frequency (Fsv) and the voice-less sampling frequency (Fsu) respond to the different frequency bands for the voice sound and the voice-less sound. This allows size reduction of fragments of the both waveforms. This does not need any large storing capacity for storing the sound waveform fragments as compared to when the single common sampling frequency is used for both the voice and voice-less sounds. Decrease in the storage capacity allows the size down of the voice synthesizer. This configuration also leads to a desirable reduction in quantity of computation.

Further, the separate optimizations to the voice sampling frequency (Fsv) and the voice-less sampling frequency (Fsu) improve the quality of the synthesized voice sound.

Furthermore, as described above, the voice sound sampling conversion unit 31 and the voice-less sound sampling conversion unit 32 respectively convert the voice sampling frequency (Fsv) and the voice-less sampling frequency (Fsu) into the common and uniform output voice sampling frequency (Fso). This configuration further allows that the separate optimizations to the voice sampling frequency (Fsv) and the voice-less sampling frequency (Fsu) may be implemented independently from the common and uniform output voice sampling frequency (Fso).

Second Embodiment

Figure 2:
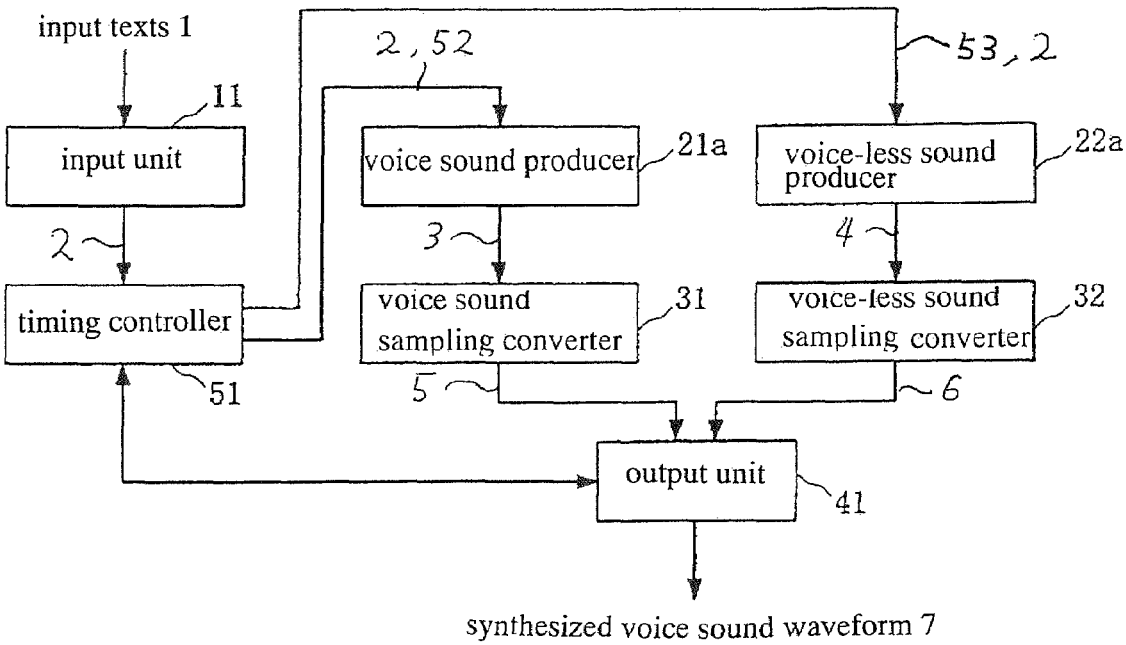
FIG. 2 is a block diagram illustrative of a configuration of a voice synthesizer in a second embodiment in accordance with the present invention.

A second embodiment according to the present invention will be described in detail with reference to the drawings. FIG. 2 is a block diagram illustrative of a configuration of a voice synthesizer in a second embodiment in accordance with the present invention. The voice synthesizer includes an input unit 11, a timing control unit 51, a voice sound producing unit 21*a*, a voice-less sound producing unit 22*a*, a voice sound sampling conversion unit 31, a voice-less sound sampling conversion unit 32, and an output unit 41.

The input unit 11 receives an entry of input texts 1 which represent characters to be spoken, and produces pronunciation informations 2 necessary for producing the voice, such as a series of rhymes. The pronunciation informations 2 are transmitted to both the voice sound producing unit 21*a* and the voice-less sound producing unit 22*a*.

The timing control unit 51 receives the pronunciation informations 2 from the input unit 11, and produces a voice sound producing timing information 52 for each sample and a voice-less sound producing timing information 53 for each sample, so that the timing control unit 51 outputs the pronunciation informations 2 and further the voice sound producing timing information 52 and the voice-less sound producing timing information 53.

A first set of the pronunciation informations 2 and the voice sound producing timing information 52 is transmitted from the timing control unit 51 into the voice sound producing unit 21*a*. A second set of the pronunciation informations 2 and the voice-less sound producing timing information 53 is transmitted from the timing control unit 51 into the voice-less sound producing unit 22*a*.

The timing control unit 51 may, if any, be adjusted to output a clock signal which is also transmitted to both the voice sound producing unit 21*a* and the voice-less sound producing unit 22*a*.

The voice sound waveform is produced at the voice sampling frequency (Fsv), whilst the voice-less sound waveform is produced at the voice-less sampling frequency (Fsu). The timing control unit 51 performs the controls to sampling timings at a uniform and single operational frequency (Fso) which is equal to the output voice sampling frequency (Fso). If the output unit 41 comprises a D/A converter, then the timing control unit 51 may be adjusted to receive the clock for the operational frequency (Fso) from the output unit 41. Alternatively, the timing control unit 51 may be adjusted to produce the clock for the operational frequency (Fso), which is transmitted to the output unit 41.

The voice sound producing unit 21*a* receives the first set of the pronunciation informations 2 and the voice sound producing timing information 52 from the timing control unit 51. In accordance with the voice sound producing timing information 52 for each sample, the voice sound producing unit 21*a* produces a voice sound waveform 3 with the voice sampling frequency (Fsv) from each sample of the pronunciation informations 2. The pronunciation informations 2 include a voice component, a voice-less component and a sound-less component. This voice component has the above voice sound waveform 3. The voice component, the voice-less component and the sound-less component appear alternatively in the real vocal sound. Only the voice component is produced, If the voice component and the voice-less component overlap together in time, then only the overlapping portion of the voice component is produced.

The voice-less sound producing unit 22*a* receives the second set of the pronunciation informations 2 and the voice-less sound producing timing information 53 from the input unit 11. In accordance with the voice-less sound producing timing information 53 for each sample, the voice-less sound producing unit 22*a* produces a voice-less sound waveform 4 with the voice-less sampling frequency (Fsu) from each sample of the pronunciation informations 2.

Figure 3:
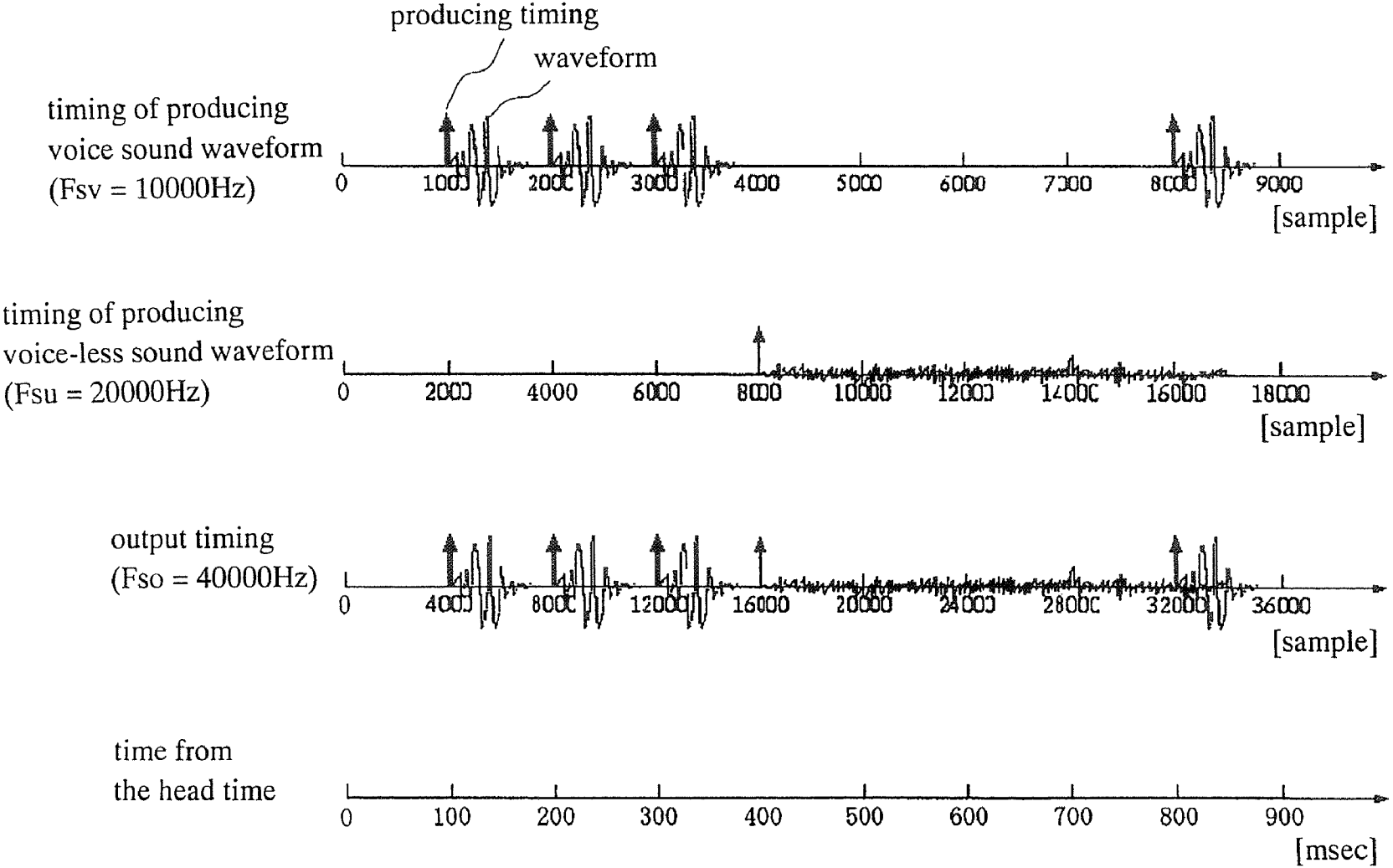
FIG. 3 is a timing chart illustrative of voice and voice-less sound waveforms as well as an output voice sound waveform in connection with the voice synthesizer of FIG. 2.

FIG. 3 is a timing chart illustrative of voice and voice-less sound waveforms as well as an output voice sound waveform in connection with the voice synthesizer of FIG. 2. The voice sampling frequency (Fsv) is 10000 Hz. The voice-less sampling frequency (Fsu) is 20000 Hz. The output sampling frequency (Fso) is 40000 Hz. At respective times of 100 msec., 200 msec., 300 msec., and 800 msec., from the head, the productions of the voice sound waveforms are started, wherein the respective timings of the productions are represented by the broader arrow marks. At a time of 400 msec., from the head, the productions of the voice-less sound waveform with a length of 450 msec. is started The timing control unit 51 may be adjusted to perform one output of the clock with the voice sampling frequency (Fsv) for every four samples over the output sampling frequency (Fso). The timing control unit 51 may also be adjusted to perform one output of the clock with the voice-less sampling frequency (Fsu) for every two samples over the output sampling frequency (Fso).

The timing control unit 51 transmits the voice sound producing timing information 52 to the voice sound producing unit 21*a* for starting the driving at pitch "A" of the production of the voice sound waveform at the timing of $4000^{th}$ sample over the output sampling frequency (Fso) or of $1000^{th}$ sample over the voice sampling frequency (Fsv). The timing control unit 51 also transmits the voice sound producing timing information 52 to the voice sound producing unit 21*a* for starting the driving at pitch "B" of the production of the voice sound waveform at the timing of $8000^{th}$ sample over the output sampling frequency (Fso) or of $2000^{th}$ sample over the voice sampling frequency (Fsv). The timing control unit 51 also transmits the voice sound producing timing information 52 to the voice sound producing unit 21*a* for starting the driving at pitch "C" of the production of the voice sound waveform at the timing of $12000^{th}$ sample over the output sampling frequency (Fso) or of $3000^{th}$ sample over the voice sampling frequency (Fsv).

The timing control unit 51 also transmits the voice-less sound producing timing information 53 to the voice-less sound producing unit 22*a* for starting the driving at pitch "D" of the production of the voice-less sound waveform at the timing of $16000^{th}$ sample over the output sampling frequency (Fso) or of $8000^{th}$ sample over the voice-less sampling frequency (Fsu). The timing control unit 51 also transmits the voice sound producing timing information 52 to the voice sound producing unit 21*a* for starting the driving at pitch "E" of the production of the voice sound waveform at the timing of $32000^{th}$ sample over the output sampling frequency (Fso) or of $8000^{th}$ sample over the voice sampling frequency (Fsv).

The voice sound sampling conversion unit 31 receives the voice sampling frequency (Fsv) from the voice sound producing unit 21*a*, and converts the received voice sampling frequency (Fsv) into an output sampling frequency (Fso), so that the voice sound sampling conversion unit 31 produces a frequency-converted voice sound waveform 5 with the output sampling frequency (Fso). If the voice sampling frequency (Fsv) is equal to the output sampling frequency (Fso), then the above conversion is not necessary, for which reason the voice sound sampling conversion unit 31 simply outputs the frequency-unconverted voice sound waveform 5 without the above conversion process.

The voice-less sound sampling conversion unit 32 also receives the voice-less sampling frequency (Fsu) from the voice-less sound producing unit 22*a*, and converts the received voice-less sampling frequency (Fsu) into the above-described output sampling frequency (Fso), so that the voice-less sound sampling conversion unit 32 produces a frequency-converted voice-less sound waveform 6 with the output sampling frequency (Fso). If the voice-less sampling frequency (Fsu) is equal to the output sampling frequency (Fso), then the above conversion is not necessary, for which reason the voice-less sound sampling conversion unit 32 simply outputs the frequency-unconverted voice-less sound waveform 6 without the above conversion process.

The output unit 41 receives both the frequency-converted voice sound waveform 5 and the frequency-unconverted voice-less sound waveform 6 from the voice sound sampling conversion unit 31 and the voice-less sound sampling conversion unit 32 respectively, wherein the frequency-converted voice sound waveform 5 and the frequency-unconverted voice-less sound waveform 6 have the same sampling frequency, for example, the output sampling frequency (Fso). The output unit 41 synthesizes the frequency-converted voice sound waveform 5 and the frequency-unconverted voice-less sound waveform 6 to produce a single synthesized voice sound waveform 7.

The voice sound and the voice-less sound are separately produced by the separate two units, for which reason it is necessary that the frequency-converted voice sound waveform 5 and the frequency-unconverted voice-less sound waveform 6 are synchronized with each other or have the same timing as each other, in order to produce the single synthesized voice sound waveform 7. This synchronization may be implemented by the following example of the methods. The pronunciation informations 2 may include time informations at respective boundaries of the sound fragments, so that separate operations of the voice sound producing unit 21*a* and the voice-less sound producing unit 22*a* are synchronized with each other depending on the time informations, so as to produce the voice sound waveform 3 and the voice-less sound waveform 4 at the synchronized timing for synchronizing the input timings over the voice sampling frequency (Fsv) and the voice-less sampling frequency (Fsu) to the output timing over the output voice sampling frequency (Fso).

The above described voice synthesizer in accordance with the second embodiment provides the following advantages. The voice sound and the voice-less sound are separately produced by the separate two units. Namely, the voice sound producing unit 21*a* generates the voice sound waveform 3 with the voice sampling frequency (Fsv) as a first optimum sampling frequency, and separately the voice-less sound producing unit 22*a* generates the voice-less sound waveform 4 with the voice-less sampling frequency (Fsu) as a second optimum sampling frequency. This allows separate optimizations to the voice sampling frequency (Fsv) and the voice-less sampling frequency (Fsu) respectively at different or equal frequency values.

As described above, it is likely that a power of the voice sound is concentrated in a lower frequency band than that of a power of the voice-less sound. The separate optimizations to the voice sampling frequency (Fsv) and the voice-less sampling frequency (Fsu) respond to the different frequency bands for the voice sound and the voice-less sound. This allows size reduction of fragments of the both waveforms. This does not need any large storing capacity for storing the sound waveform fragments as compared to when the single common sampling frequency is used for both the voice and voice-less sounds. Decrease in the storage capacity allows the size down of the voice synthesizer. This configuration also leads to a desirable reduction in quantity of computation.

Further, the separate optimizations to the voice sampling frequency (Fsv) and the voice-less sampling frequency (Fsu) improve the quality of the synthesized voice sound.

Furthermore, as described above, the voice sound sampling conversion unit 31 and the voice-less sound sampling conversion unit 32 respectively convert the voice sampling frequency (Fsv) and the voice-less sampling frequency (Fsu) into the common and uniform output voice sampling frequency (Fso). This configuration further allows that the separate optimizations to the voice sampling frequency (Fsv) and the voice-less sampling frequency (Fsu) may be implemented independently from the common and uniform output voice sampling frequency (Fso).

The timings for producing the voice sound waveform and the voice-less sound waveform for every samples are controlled over the common output voice sampling frequency (Fso). The producing timing of the voice sound waveform is converted into a producing timing over the voice sampling frequency (Fsv), and the producing timing of the voice-less sound waveform is converted into another producing timing over the voice-less sampling frequency (Fsu). The productions of the voice sound waveform and the voice-less sound waveform are made over the respective converted production times for every samples in accordance with the predetermined production procedures. The timings for producing the voice sound waveform and the voice-less sound waveform for every samples are thus synchronized with the common output voice sampling frequency (Fso).

Third Embodiment

A third embodiment according to the present invention will be described in detail with reference to the drawings. The voice synthesizer of this third embodiment in accordance with the present invention has the same structure as shown in FIG. 2 and described in the above second embodiment. The voice synthesizer of this third embodiment is different from that of the second embodiment only in the control by the timing control unit 51 to the timings of the productions of the voice sound waveform by the voice sound producing unit 21*a* and of the voice-less sound waveform by the voice-less sound producing unit 22*a*. In order to avoid the duplicate descriptions, the following descriptions will focus on the control operation by the control unit 51 to the timings of the productions of the voice sound waveform by the voice sound producing unit 21*a* and of the voice-less sound waveform by the voice-less sound producing unit 22*a*.

Figure 4:
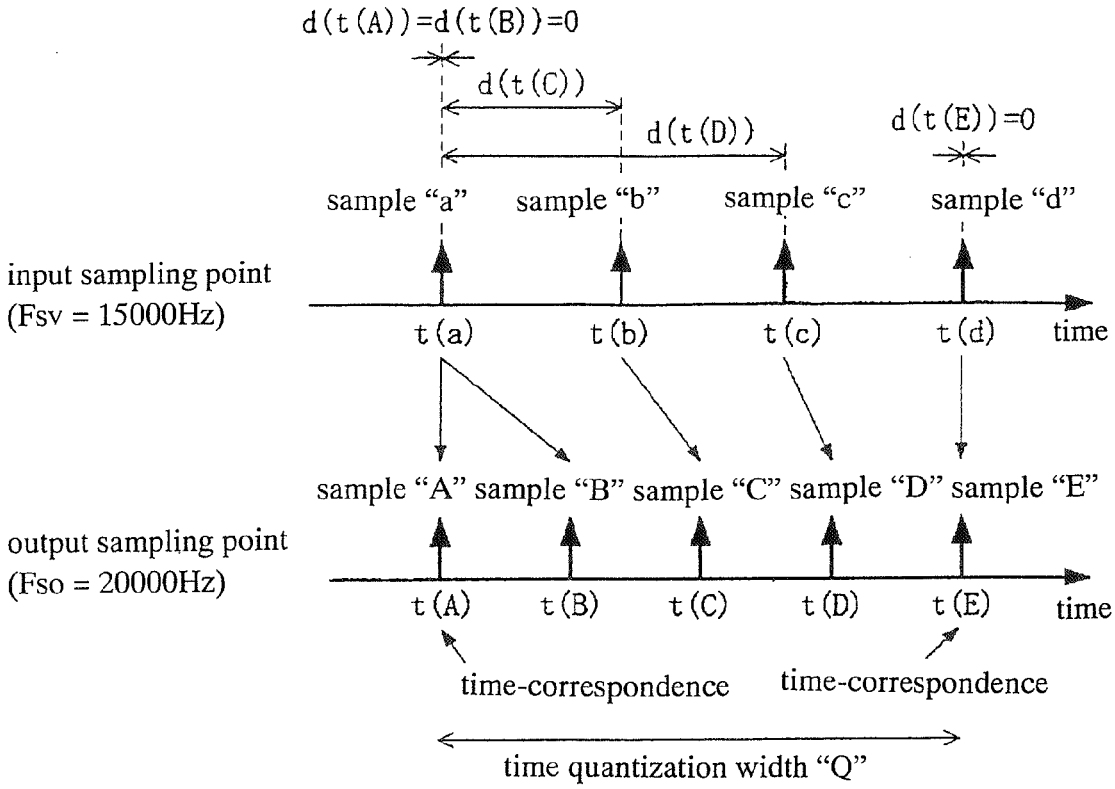
FIG. 4 is a diagram illustrative of the inputs and outputs of the voice sound sampling conversion unit included in the voice synthesizer of the third embodiment in accordance with the present invention.

The voice sound sampling conversion unit 31 and the voice-less sound sampling conversion unit 32 may be adjusted to convert, by use of internal buffers, the voice sampling frequency (Fsv) and the voice-less sampling frequency (Fsu) into the output voice sampling frequency (Fso). The use of the internal buffers causes time quantization and time delay in operations. FIG. 4 is a diagram illustrative of the inputs and outputs of the voice sound sampling conversion unit included in the voice synthesizer of the third embodiment in accordance with the present invention. As one example, it is assumed that the voice sampling frequency (Fsv) is 15000 Hz, and the voice-less sampling frequency (Fsu) is 20000 Hz, and also assumed that the voice sound sampling conversion unit 31 converts the voice sampling frequency (Fsv) into the output voice sampling frequency (Fso) by use of a poly-phase filter with an interoperation rate 4 and a decimation rate 3.

The voice sound waveform 3 with the voice sampling frequency (Fsv) is inputted into the voice sound sampling conversion unit 31. The frequency-converted voice sound waveform 5 with the output voice sampling frequency (Fso) is outputted from the voice sound sampling conversion unit 31. There exist, at the input into the voice sound sampling conversion unit 31, sampling points Sample "a" at time t(a), Sample "b" at time t(b), Sample "c" at time t(c), and Sample "d" at time t(d). There exist, at the output into the voice sound sampling conversion unit 31, sampling points Sample "A" at time t(A), Sample "B" at time t(B), Sample "C" at time t(C), Sample "D" at time t(D), and Sample "E" at time t(E).

The Sample "a" at time t(a) corresponds in time to the Sample "A" at time t(A), and the Sample "B" at time t(B). The Sample "b" at time t(b) is in connection with but not corresponds in time to the Sample "C" at time t(C). The Sample "c" at time t(c) is also in connection with but not corresponds to the Sample "D" at time t(D). The Sample "d" at time t(d) corresponds in time to the Sample "E" at time t(E).

Those correspondences of the sampling points at the input and the output of the voice sound sampling conversion unit 31 are defined to be the time quantization of the operation. A cycle of the correspondences, for example, between times "t(A)" and "t(E)" or times "t(a)" and "t(d)" is defined to be a time quantization width "Q". In this embodiment, the sampling frequency conversion is made based on the time quantization width "Q" as a unit, even other conversion methods may also be available.

The output samples "A" and "B" are defined at the timing of input of the input sample "a". The output sample "C" is defined with a first time delay from the input of the input sample "a", wherein the first time delay is a time period until an input of the input sample "c" from the input of the input sample "a". Namely, the first time delay is given by d(t(C))=t(c)−t(a). The waiting time until the definition of the output sample (X) from the head of the time quantization width "Q" is defined to be the time quantization delay d(t(X)).

If the timing control unit 51 decided to perform the pitch driving operation at the output sample point "X", then it is necessary that the pitch driving is started with the time quantization delay d(t(X)) from the head of the time quantization width "Q". The starting time is not later than the output sampling point "X", for which reason it is convenient to deal with the plural sampling points based on the single head time of the time quantization width "Q".

The timing control unit 51 may be adjusted to detect, at the head time (output sample "A") of the time quantization width "Q", any need of action in connection with each of the output samples "A", "B", "C" and "D" in the time quantization width "Q". If any action is needed, then the timing control unit 51 decides the pronunciation informations 2 and the time quantization delay in connection with each of the output samples "A", "B", "C" and "D". Examples of the needed actions are the pitch driving of the voice sound waveform production and also the driving of the voice-less sound waveform production.

In the above case shown in FIG. 4, the pronunciation information for producing the input sample "a" and the time quantization delays d(t(A)) and d(t(B)) are decided in connection with the output samples "A" and "B". The pronunciation information for producing the input sample "b" and the time quantization delay d(t(C)) are decided in connection with the output sample "C". The pronunciation information for producing the input sample "c" and the time quantization delay d(t(D)) are decided in connection with the output sample "D".

The timing control unit 51 transmits, to the voice sound producing unit 21*a*, respective pairs of the pronunciation information and the time quantization delay for every output samples at the head time of the time quantization width "Q". The voice sound producing unit 21*a* produces the voice sound waveform in connection with the input sample "x" in correspondence with the output sample "X" with the time quantization delay d(t(X)) from the head of the time quantization width "Q" by use of the pronunciation information in connection with the output sample "X". For example, with the time quantization delay d(t(C)) from the head of the time quantization width "Q", the voice sound producing unit 21*a* produces the voice sound waveform in connection with the input sample "b" in correspondence with the output sample "C".

The above description with reference to FIG. 4 is in connection with the voice sound waveform production by the voice sound producing unit 21*a*. Notwithstanding, the pronunciation information for producing the input sample and the time quantization delay are decided in the same method as described above. The timing control unit 51 also transmits, to the voice-less sound producing unit 22*a*, the respective pairs of the pronunciation information and the time quantization delay for every output samples at the head time of the time quantization width "Q". The voice-less sound producing unit 22*a* produces the voice-less sound waveform in connection with the input sample "y" in correspondence with the output sample "Y" with the time quantization delay d(t(X)) from the head of the time quantization width "Q" by use of the pronunciation information in connection with the output sample "Y".

The voice sound sampling conversion unit 31 receives the voice sampling frequency (Fsv) from the voice sound producing unit 21*a*, and converts the received voice sampling frequency (Fsv) into an output sampling frequency (Fso), so that the voice sound sampling conversion unit 31 produces a frequency-converted voice sound waveform 5 with the output sampling frequency (Fso). If the voice sampling frequency (Fsv) is equal to the output sampling frequency (Fso), then the above conversion is not necessary, for which reason the voice sound sampling conversion unit 31 simply outputs the frequency-unconverted voice sound waveform 5 without the above conversion process.

The voice-less sound sampling conversion unit 32 also receives the voice-less sampling frequency (Fsu) from the voice-less sound producing unit 22*a*, and converts the received voice-less sampling frequency (Fsu) into the above-described output sampling frequency (Fso), so that the voice-less sound sampling conversion unit 32 produces a frequency-converted voice-less sound waveform 6 with the output sampling frequency (Fso). If the voice-less sampling frequency (Fsu) is equal to the output sampling frequency (Fso), then the above conversion is not necessary, for which reason the voice-less sound sampling conversion unit 32 simply outputs the frequency-unconverted voice-less sound waveform 6 without the above conversion process.

The output unit 41 receives both the frequency-converted voice sound waveform 5 and the frequency-unconverted voice-less sound waveform 6 from the voice sound sampling conversion unit 31 and the voice-less sound sampling conversion unit 32 respectively, wherein the frequency-converted voice sound waveform 5 and the frequency-unconverted voice-less sound waveform 6 have the same sampling frequency, for example, the output sampling frequency (Fso).

The output unit 41 synthesizes the frequency-converted voice sound waveform 5 and the frequency-unconverted voice-less sound waveform 6 to produce a single synthesized voice sound waveform 7.

In addition to the above effects described in the second embodiment, the voice synthesizer of this third embodiment provides the following additional effects. Time correspondences between the frequency-unconverted sample point as the input sample and the frequency-converted sample point as the input sample are verified. Adjacent two of the time correspondences are defined to be the head and the bottom of the time quantization, wherein the width of the time quantization is defined by the adjacent two of the time correspondences. The time quantization delay is defined to be the waiting time for defining each of the frequency-converted samples as the output samples from the head time of the time quantization width "Q". Plural pairs of the pronunciation information and the time quantization delay for every samples, which are planted to be produced in the time quantization width "Q", are decided at the head time of the time quantization width "Q". With the time quantization delay in connection with the frequency-converted sample as the output sample, the voice sound waveform for the frequency-unconverted sample as the input sample is produced by the voice sound producing unit in accordance with the pronunciation information in correspondence with the frequency-converted sample. With the time quantization delay in connection with the frequency-converted sample as the output sample, the voice-less sound waveform for the frequency-unconverted sample as the input sample is produced by the voice-less sound producing unit in accordance with the pronunciation information in correspondence with the frequency-converted sample, so as to produce the voice sound waveform 3 and the voice-less sound waveform 4 at the synchronized timing for synchronizing the input timings over the voice sampling frequency (Fsv) and the voice-less sampling frequency (Fsu) to the output timing over the output voice sampling frequency (Fso).

Fourth Embodiment

Figure 5:
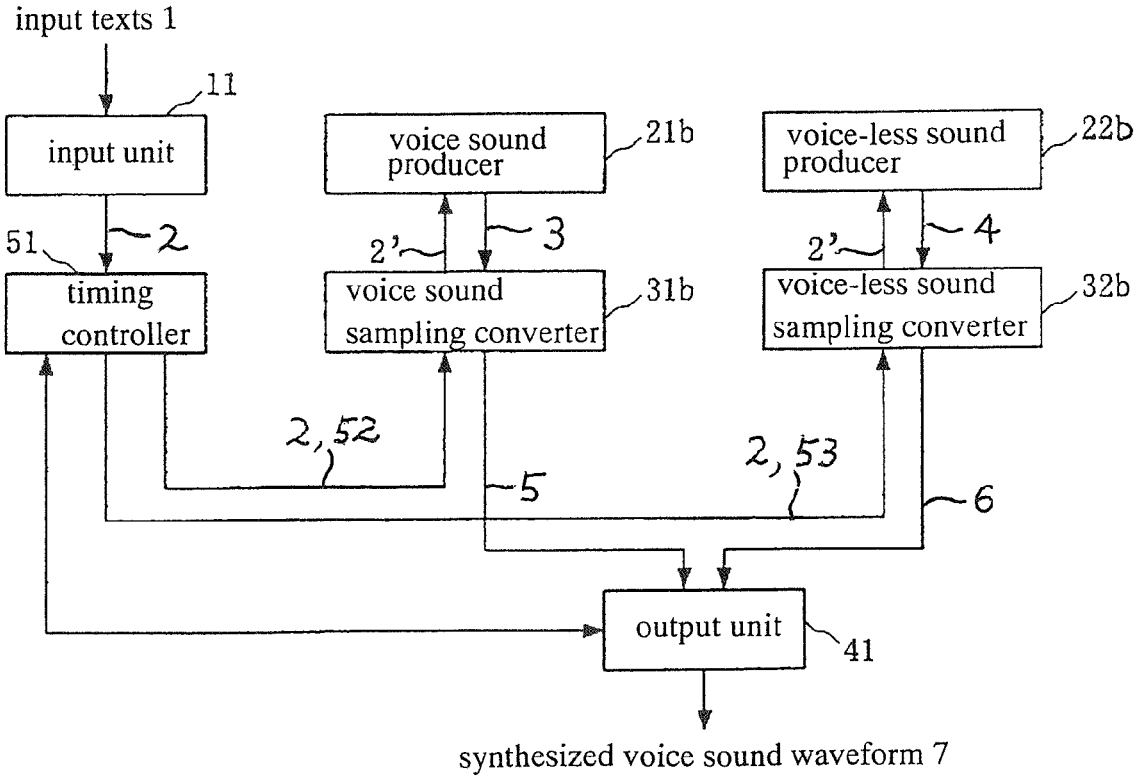
FIG. 5 is a block diagram illustrative of the voice synthesizer in the fourth embodiment in accordance with the present invention.

A fourth embodiment according to the present invention will be described in detail with reference to the drawings. The voice synthesizer of this fourth embodiment in accordance with the present invention performs the same functions as described above in the third embodiment with reference to shown in FIG. 4. FIG. 5 is a block diagram illustrative of the voice synthesizer in the fourth embodiment in accordance with the present invention. The voice synthesizer of this fourth embodiment is different from that of the third embodiment only in the configuration, wherein the voice sound sampling conversion unit 31*b* controls the voice sound producing unit 21*b*, whilst the voice-less sound sampling conversion unit 32*b* controls the voice-less sound producing unit 22*b*.

Namely, the voice synthesizer includes an input unit 11, a timing control unit 51, a voice sound producing unit 21*b*, a voice-less sound producing unit 22*b*, a voice sound sampling conversion unit 31*b*, a voice-less sound sampling conversion unit 32*b*, and an output unit 41. In order to avoid the duplicate descriptions, the following descriptions will focus on the differences of this fourth embodiment from the above third embodiment.

A first set of the pronunciation informations 2 and the voice sound producing timing information 52 is transmitted from the timing control unit 51 into the voice sound sampling conversion unit 31*b*. A second set of the pronunciation informations 2 and the voice-less sound producing timing information 53 is transmitted from the timing control unit 51 into the voice-less sound sampling conversion unit 32*b*.

Both the time quantization width "Q" and the time quantization delay d(t(X)) depend on the configurations of the voice sound sampling conversion unit 31*b* and the voice-less sound sampling conversion unit 32*b*.

The voice sound sampling conversion unit 31*b* is adjusted to perform buffering the pronunciation information for each sample, transmitted from the timing control unit 51 by a buffering time which corresponds to an estimated time quantization width "Q" based on the number of the frequency converted output samples over the output voice sampling frequency (Fso).

The voice sound sampling conversion unit 31*b* recognizes that a time, when the buffering time is filled up, be the head time of the estimated time quantization width "Q". The voice sound sampling conversion unit 31*b* calculates respective time quantization delays d(t(X)) in connection with pronunciation informations for every samples. With the time quantization delay d(t(X)) from the time when the buffering time was filled up, the voice sound sampling conversion unit 31*b* transmits the pronunciation information 2' of the sample "X" into the voice sound producing unit 21*b*.

With reference again to FIG. 4, the timing control unit 51 is adjusted to transmit, to the voice sound sampling conversion unit 31*b*, a pronunciation information in connection with the frequency-unconverted input sample "a" at the head time of the time quantization width "Q". The timing control unit 51 is also adjusted to transmit, to the voice sound sampling conversion unit 31*b*, another pronunciation information in connection with the frequency-unconverted input sample "b" at a time t(b) and with a time quantization delay d(t(C)) from the head time of the time quantization width "Q". The timing control unit 51 is also adjusted to transmit, to the voice sound sampling conversion unit 31*b*, still another pronunciation information in connection with the frequency-unconverted input sample "c" at a time t(c) and with a time quantization delay d(t(D)) from the head time of the time quantization width "Q".

The voice-less sound sampling conversion unit 32*b* is also adjusted to perform buffering the pronunciation information for each sample, transmitted from the timing control unit 51 by a buffering time which corresponds to an estimated time quantization width "Q" based on the number of the frequency converted output samples over the output voice sampling frequency (Fso).

The voice-less sound sampling conversion unit 32*b* recognizes that a time, when the buffering time is filled up, be the head time of the estimated time quantization width "Q". The voice-less sound sampling conversion unit 32*b* calculates respective time quantization delays d(t(X)) in connection with pronunciation informations for every samples. With the time quantization delay d(t(X)) from the time when the buffering time was filled up, the voice-less sound sampling conversion unit 32*b* transmits the pronunciation information 2' of the sample "X" into the voice sound producing unit 22*b*.

The voice sound producing unit 21*b* receives the respective pronunciation informations 2' for every samples from the voice sound sampling conversion unit 31*b*. The voice sound producing unit 21*b* produces the frequency-unconverted voice sound waveform 3 with the voice sampling frequency (Fsv) based on the received pronunciation information 2' for every samples. The voice sound producing unit 21*b* transmits the frequency-unconverted voice sound waveform 3 with the voice sampling frequency (Fsv) to the voice sound sampling conversion unit 31*b*.

The voice-less sound producing unit 22*b* also receives the respective pronunciation informations 2' for every samples from the voice-less sound sampling conversion unit 32*b*. The voice-less sound producing unit 22*b* produces the frequency-unconverted voice-less sound waveform 4 with the voice-less sampling frequency (Fsu) based on the received pronunciation information 2' for every samples. The voice-less sound producing unit 22*b* transmits the frequency-unconverted voice-less sound waveform 4 with the voice-less sampling frequency (Fsu) to the voice-less sound sampling conversion unit 32*b*.

The voice sound sampling conversion unit 31*b* receives the frequency-unconverted voice sound waveform 3 with the voice sampling frequency (Fsv) from the voice sound producing unit 21*b*. The voice sound sampling conversion unit 31*b* converts the received voice sampling frequency (Fsv) into an output sampling frequency (Fso), so that the voice sound sampling conversion unit 31*b* produces a frequency-converted voice sound waveform 5 with the output sampling frequency (Fso). If the voice sampling frequency (Fsv) is equal to the output sampling frequency (Fso), then the above conversion is not necessary, for which reason the voice sound sampling conversion unit 31*b* simply outputs the frequency-unconverted voice sound waveform 5 without the above conversion process.

The voice-less sound sampling conversion unit 32*b* also receives the frequency-unconverted voice sound waveform 3 with the voice-less sampling frequency (Fsu) from the voice-less sound producing unit 22*b*. The voice-less sound sampling conversion unit 32*b* converts the received voice-less sampling frequency (Fsu) into the above-described output sampling frequency (Fso), so that the voice-less sound sampling conversion unit 32*b* produces a frequency-converted voice-less sound waveform 6 with the output sampling frequency (Fso). If the voice-less sampling frequency (Fsu) is equal to the output sampling frequency (Fso), then the above conversion is not necessary, for which reason the voice-less sound sampling conversion unit 32 simply outputs the frequency-unconverted voice-less sound waveform 6 without the above conversion process.

The output unit 41 receives both the frequency-converted voice sound waveform 5 and the frequency-unconverted voice-less sound waveform 6 from the voice sound sampling conversion unit 31 and the voice-less sound sampling conversion unit 32 respectively, wherein the frequency-converted voice sound waveform 5 and the frequency-unconverted voice-less sound waveform 6 have the same sampling frequency, for example, the output sampling frequency (Fso). The output unit 41 synthesizes the frequency-converted voice sound waveform 5 and the frequency-unconverted voice-less sound waveform 6 to produce a single synthesized voice sound waveform 7.

In addition to the above effects described in the second embodiment, the voice synthesizer of this fourth embodiment provides the same additional effects as described in the third embodiment. Time correspondences between the frequency-unconverted sample point as the input sample and the frequency-converted sample point as the input sample are verified. Adjacent two of the time correspondences are defined to be the head and the bottom of the time quantization, wherein the width of the time quantization is defined by the adjacent two of the time correspondences. The time quantization delay is defined to be the waiting time for defining each of the frequency-converted samples as the output samples from the head time of the time quantization width "Q". Plural pairs of the pronunciation information and the time quantization delay for every samples, which are planted to be produced in the time quantization width "Q", are decided at the head time of the time quantization width "Q". With the time quantization delay in connection with the frequency-converted sample as the output sample, the voice sound waveform for the frequency-unconverted sample as the input sample is produced by the voice sound producing unit in accordance with the pronunciation information in correspondence with the frequency-converted sample. With the time quantization delay in connection with the frequency-converted sample as the output sample, the voice-less sound waveform for the frequency-unconverted sample as the input sample is produced by the voice-less sound producing unit in accordance with the pronunciation information in correspondence with the frequency-converted sample, so as to produce the voice sound waveform 3 and the voice-less sound waveform 4 at the synchronized timing for synchronizing the input timings over the voice sampling frequency (Fsv) and the voice-less sampling frequency (Fsu) to the output timing over the output voice sampling frequency (Fso).

Fifth Embodiment

A fifth embodiment according to the present invention will be described in detail with reference to the drawings. The fifth embodiment provides modifications to the above-described third and fourth embodiments. In accordance with the above-described third and fourth embodiments, the time quantization delay d(t(X)) in the time quantization width "Q" is taken into account for synchronizing the input timings over the voice sampling frequency (Fsv) and the voice-less sampling frequency (Fsu) to the output timing over the output voice sampling frequency (Fso).

Figure 6:
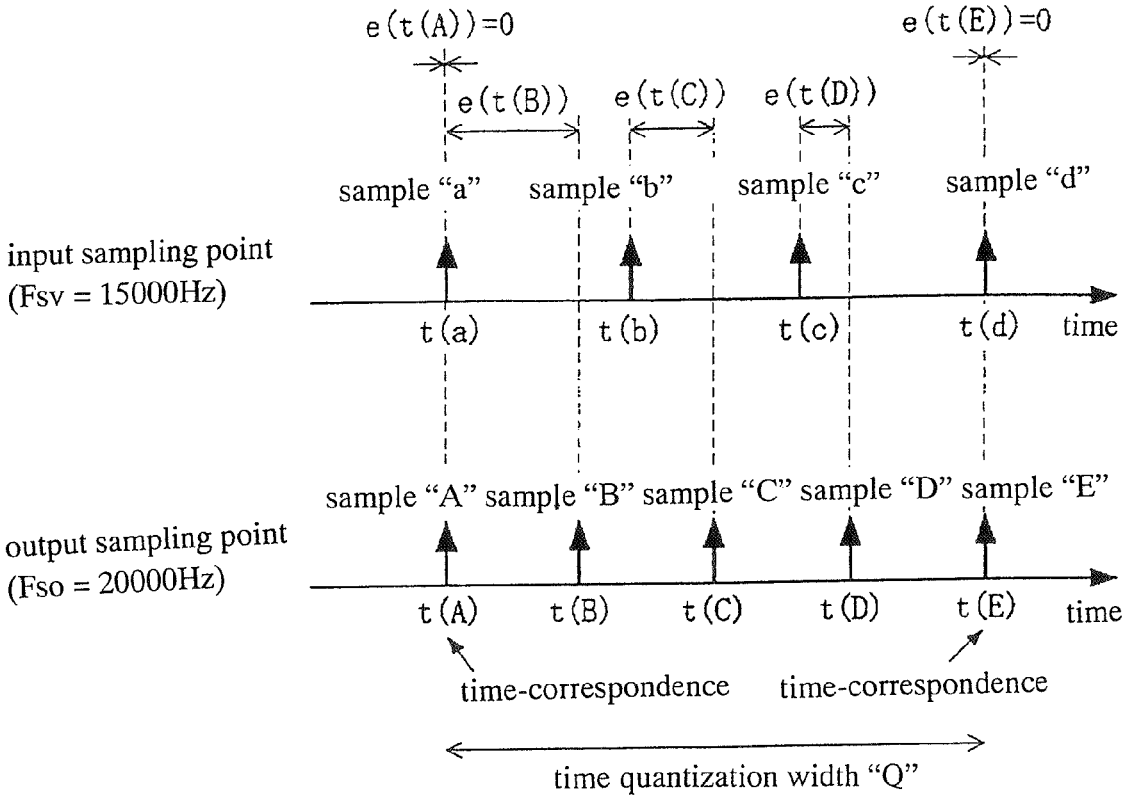
FIG. 6 is a diagram illustrative of the inputs and outputs of the voice sound sampling conversion unit included in the voice synthesizer of the fifth embodiment in accordance with the present invention.

FIG. 6 is a diagram illustrative of the inputs and outputs of the voice sound sampling conversion unit included in the voice synthesizer of the fifth embodiment in accordance with the present invention. As one example, it is assumed that the voice sampling frequency (Fsv) is 15000 Hz, and the voice-less sampling frequency (Fsu) is 20000 Hz.

As shown in FIG. 6, in the time quantization width "Q", there are time correspondences between the input sample "a" and the output sample "A" and between the input sample "d" and the output sample "E". Namely the opposite ends of the time quantization width "Q" have the time correspondences. Notwithstanding, there are no further time correspondences between the remaining input samples and the remaining output samples. This means that any jitter or fluctuation may appear on the finally outputted synthesized voice. For example, as shown in FIG. 6, a delay time e(t(B)) is present between the input sample "a" and the output sample "B". Another delay time e(t(C)) is present between the input sample "b" and the output sample "C". Still another delay time e(t(D)) is present between the input sample "c" and the output sample "D".

As a modification to the above-described third embodiment, in order to avoid any possible appearance of the jitter or fluctuation on the finally outputted synthesized voice, the voice synthesizer of this fifth embodiment may be adjusted to add the time quantization delay d(t(X)) with a delay time e(t(X)) which is defined until a time t(X) of the output sample "X" from a time t(x) of the input sample "x", so that the timing control unit 51 transmits, at the head time of the time quantization width "Q", respective pairs of the pronunciation information and the sum of the time quantization delay d(t(X)) and the delay time e(t(X)) for respective samples (X) to the voice sound producing unit 21*a* and the voice-less sound producing unit 22*a*.

The voice sound producing unit 21*a* produces the voice sound waveform in connection with the input sample "x" in correspondence with the output sample "X" with the time delay corresponding to the sum of the time quantization delay d(t(X)) and the delay time e(t(X)) from the head of the time quantization width "Q" by use of the pronunciation information in connection with the output sample "X".

The voice-less sound producing unit 22*a* also produces the voice-less sound waveform in connection with the input sample "x" in correspondence with the output sample "X" with the time delay corresponding to the sum of the time quantization delay d(t(X)) and the delay time e(t(X)) from the head of the time quantization width "Q" by use of the pronunciation information in connection with the output sample "X".

The voice sound waveform and the voice-less sound waveform are produced with the sum of the time quantization delay d(t(X)) and the delay time e(t(X)) in order to avoid any possible appearance of the jitter or fluctuation on the finally outputted synthesized voice.

As another modification to the above-described fourth embodiment, also in order to avoid any possible appearance of the jitter or fluctuation on the finally outputted synthesized voice, the voice synthesizer of this fifth embodiment may be adjusted to add the time quantization delay d(t(X)) with a delay time e(t(X)) which is defined until a time t(X) of the output sample "X" from a time t(x) of the input sample "x".

The voice sound sampling conversion unit 31*b* calculates the sum of the time quantization delay d(t(X)) and the delay time e(t(X)) for respective samples (X). With the time delay corresponding to the calculated sum of the time quantization delay d(t(X)) and the delay time e(t(X)) from the time when the buffering time was filled up, the voice sound sampling conversion unit 31*b* transmits the pronunciation information 2' to the voice sound producing unit 21*b*.

The voice-less sound sampling conversion unit 32*b* also calculates the sum of the time quantization delay d(t(X)) and the delay time e(t(X)) for respective samples (X). With the time delay corresponding to the calculated sum of the time quantization delay d(t(X)) and the delay time e(t(X)) from the time when the buffering time was filled up, the voice-less sound sampling conversion unit 32*b* transmits the pronunciation information 2' to the voice-less sound producing unit 22*b*.

The voice sound waveform and the voice-less sound waveform are produced with the sum of the time quantization delay d(t(X)) and the delay time e(t(X)) in order to avoid any possible appearance of the jitter or fluctuation on the finally outputted synthesized voice.

A conventional method for avoiding the time delay in the single sample is disclosed in Japanese laid-open patent publication No. 9-319390. Notwithstanding, in accordance with this fifth embodiment, in each of the voice sound sampling conversion unit 31*b* and the voice-less sound sampling conversion unit 32, a filtering coefficient is prepared and driven, which includes a superimposition with a phase shift which further corresponds to the delay time e(t(X)) from the input sample point, whereby the above-described desirable effect for avoiding any possible appearance of the jitter or fluctuation on the finally outputted synthesized voice, without remarkable increase of the calculation amount.

In place of the above-described superimposition into the filtering coefficient, it is alternatively possible that the voice sound producing unit 21*b* and the voice-less sound producing unit 22*b* are adjusted to modified voice sound and voice-less sound waveforms which include the above-described superimposition with the phase shift which further corresponds to the delay time e(t(X)) from the input sample point. This method is particularly effective for the voice-synthesis in the waveform editting method.

In addition, it is possible as a modification to each of the foregoing embodiments that the above-described voice synthesizer may be integrated in a semiconductor device or a computer chip.

It is also possible as another modification to each of the foregoing embodiments that the above-described voice synthesizer may be implemented by any available computer system, for example, the system may include a central processing unit (CPU), a read only memory (ROM), a random access memory (RAM), a display, and an input device such as a key board or an interface to an external memory. The CPU may execute a program loaded from the ROM or RAM, or may operate in accordance with commands externally entered via the input device. The CPU may also be configured to write data to the external memory or read out data from the external memory.

The computer-readable program to be executed to implement the above-described voice synthesizing method may optionally be stored in any available storing medium such as flexible disk, CD-ROM, DVD-ROM, and memory card. The computer-readable program may be loaded to an external storage device and then transferred from the external storage device to the CPU for subsequent writing the program into the RAM.

Although the invention has been described above in connection with several preferred embodiments therefore, it will be appreciated that those embodiments have been provided solely for illustrating the invention, and not in a limiting sense. Numerous modifications and substitutions of equivalent materials and techniques will be readily apparent to those skilled in the art after reading the present application, and all such modifications and substitutions are expressly understood to fall within the true scope and spirit of the appended claims.

What is claimed is:

1. A method of producing a synthesized voice, said method including producing a voice sound waveform at a voice sampling frequency based on pronunciation informations;

producing a voice-less sound waveform at a voice-less sampling frequency based on said pronunciation informations;

converting said voice sampling frequency into an output sampling frequency to produce a frequency-converted voice sound waveform with said output sampling frequency, wherein each of said voice sampling frequency and said voice-less sampling frequency is independent from said output sampling frequency; and converting said voice-less sampling frequency into said output sampling frequency to produce a frequency-converted voice-less sound waveform with said output sampling frequency.

2. The method as claimed in claim 1, further including managing, over said output sampling frequency, a first voice production timing of producing said voice sound waveform and a first voice-less production timing of producing said voice-less sound waveform for each sample;

converting said first voice production timing into a second voice production timing over said voice sampling frequency to produce said voice sound waveform at said second voice production timing for every samples; and converting said first voice-less production timing into a second voice-less production timing over said voice-less sampling frequency to produce said voice-less sound waveform at said second voice-less production timing for every samples.

3. The method as claimed in claim 1, further including synthesizing said frequency-converted voice sound waveform and said frequency-converted voice-less sound waveform to produce a synthesized voice with said output sampling frequency.

4. The method as claimed in claim 3, further including:

producing said pronunciation informations based on an externally inputted information.

5. A system of producing a synthesized voice, said system including means for producing a voice sound waveform at a voice sampling frequency based on pronunciation informations;

means for producing a voice-less sound waveform at a voice-less sampling frequency based on said pronunciation informations;

means for converting said voice sampling frequency into an output sampling frequency to produce a frequency-converted voice sound waveform with said output sampling frequency, wherein each of said voice sampling frequency and said voice-less sampling frequency is independent from said output sampling frequency ; and means for converting said voice-less sampling frequency into said output sampling frequency to produce a frequency-converted voiceless sound waveform with said output sampling frequency.

6. The system as claimed in claim 5, further including means for managing, over said output sampling frequency, a first voice production timing of producing said voice sound waveform and a first voice-less production timing of producing said voice-less sound waveform for each sample;

means for converting said first voice production timing into a second voice production timing over said voice sampling frequency to produce said voice sound waveform at said second voice production timing for every samples ; and means for converting said first voice-less production timing into a second voice-less production timing over said voice-less sampling frequency to produce said voice-less sound waveform at said second voiceless production timing for every samples.

7. The system as claimed in claim 5, further including means for synthesizing said frequency-converted voice sound waveform and said frequency-converted voice-less sound waveform to produce a synthesized voice with said output sampling frequency.

8. The system as claimed in claim 7, further including means for producing said pronunciation informations based on an externally inputted information.

9. A voice synthesizer including a voice sound producing unit for producing a voice sound waveform at a voice sampling frequency based on pronunciation informations;

a voice-less sound producing unit for producing a voice-less sound waveform at a voice-less sampling frequency based on said pronunciation informations;

a voice sound sampling conversion unit for converting said voice sampling frequency into an output sampling frequency to produce a frequency-converted voice sound waveform with said output sampling frequency, wherein each of said voice sampling frequency and said voiceless sampling frequency is independent from said output sampling frequency; and a voice-less sound sampling conversion unit for converting said voice-less sampling frequency into said output sampling frequency to produce a frequency-converted voice-less sound waveform with said output sampling frequency.

10. The voice synthesizer as claimed in claim 9, further including an output unit for synthesizing said frequency-converted voice sound waveform and said frequency-converted voice-less sound waveform to produce a synthesized voice with said output sampling frequency.

11. The voice synthesizer as claimed in claim 10, further including an input unit for producing said pronunciation informations based on an externally inputted information.

12. The voice synthesizer as claimed in claim 9, further including a timing control unit for managing, over said output sampling frequency, a first voice production timing of producing said voice sound waveform and a first voice-less production timing of producing said voiceless sound waveform for each sample ; and said timing control unit further converting said first voice production timing into a second voice production timing over said voice sampling frequency to produce said voice sound waveform at said second voice production timing for every samples; as well as convening said first voice-less production timing into a second voice-less production timing over said voice-less sampling frequency to produce said voice-less sound waveform at said second voiceless production timing for every samples.

13. A semiconductor device integrating a voice synthesizer as claimed in any one of claims 9-12.

14. A computer-readable medium storing instructions to enable a computer to implement a method of producing a synthesized voice, said method comprising:

producing a voice sound waveform at a voice sampling frequency based on pronunciation informations; producing a voice-less sound waveform at a voice-less sampling frequency based on said pronunciation informations;

converting said voice sampling frequency into an output sampling frequency to produce a frequency-converted voice sound waveform with said output sampling frequency, wherein each of said voice sampling frequency and said voice-less sampling frequency is independent from said output sampling frequency; and converting said voice-less sampling frequency into said output sampling frequency to produce a frequency-converted voice-less sound waveform with said output sampling frequency.

15. The computer-readable medium as claimed in claim 14, further including managing, over said output sampling frequency, a first voice production tinning of producing said voice sound waveform and a first voice-less production timing of producing said voice-less sound waveform for each sample;

converting said first voice production timing into a second voice production timing over said voice sampling frequency to produce said voice sound waveform at said second voice production timing for every samples; and converting said first voice-less production timing into a second voice-less production timing over said voice-less sampling frequency to produce said voice-less sound waveform, at said second voice-less production timing for every samples.

16. The computer-readable medium as claimed in claim 14, further including:

synthesizing said frequency-converted voice sound waveform and said frequency-converted voice-less sound waveform to produce a synthesized voice with said output sampling frequency.

17. The computer-readable medium as claimed in claim 16, further including:

producing said pronunciation informations based on an externally inputted information.

* * * * *